US012297591B1

(12) United States Patent
Guimarães et al.

(10) Patent No.: US 12,297,591 B1
(45) Date of Patent: May 13, 2025

(54) DIRECT-TO-GARMENT PRINTING

(71) Applicant: Elcatex, S De R.L. De C.V., Choloma (HN)

(72) Inventors: Renato Murilo de Carvalho Guimarães, San Pedro Sula (HN); Angel Fernando Alvarado Barrientos, San Pedro Sula (HN); Octavio Rodriguez Torre, San Pedro Sula (HN)

(73) Assignee: Elcatex, S De R.L. De C.V., Choloma (HN)

( * ) Notice: Subject to any disclaimer, the term of this patent is extended or adjusted under 35 U.S.C. 154(b) by 348 days.

(21) Appl. No.: 17/651,533

(22) Filed: Feb. 17, 2022

Related U.S. Application Data

(60) Provisional application No. 63/150,240, filed on Feb. 17, 2021.

(51) Int. Cl.

| | |
|---|---|
| ***D06P 5/00*** | (2006.01) |
| ***D06B 3/30*** | (2006.01) |
| ***D06B 21/00*** | (2006.01) |
| ***D06P 1/00*** | (2006.01) |

(52) U.S. Cl.
CPC ..... *D06P 5/002* (2013.01); *D06B 3/30* (2013.01); *D06B 21/00* (2013.01); *D06P 1/0036* (2013.01)

(58) Field of Classification Search
None
See application file for complete search history.

(56) References Cited

U.S. PATENT DOCUMENTS 4,118,526 A * 10/1978 Gregorian ..... D06P 1/965 8/182
6,090,166 A * 7/2000 Girbaud ..... D06P 1/5235 8/918

* cited by examiner

*Primary Examiner* — Cristi J Tate-Sims
(74) *Attorney, Agent, or Firm* — Summit Patents, PC

(57) ABSTRACT

The described systems and methods of direct-to-garment printing (DTG) allow for DTG printing for garments which achieves high definition and good color saturation, such as in dark color garments. The disclosed systems and methods include a pre-treatment solution to immobilize the ink used on the garments for DTG printing and to reduce nearly eliminate ink absorption by the fabric (i.e., by reducing surface availability of polyvalent salt to contact). The disclosed invention also includes a pre-treatment solution including at least one of a polyvalent salt, amorphous nanoparticles, a solid dispersive diluent, a stabilizer solution, a booster, and a tension activator.

21 Claims, 2 Drawing Sheets

102b

106

DIRECT-TO-GARMENT PRINTING

CROSS-REFERENCE TO RELATED APPLICATIONS

This application claims priority and benefit from the U.S. Provisional Patent Application 63/150,240, filed Feb. 17, 2021 and titled, "DIRECT-TO-GARMENT PRINTING," which are incorporated herein by reference in their entirety for all purposes.

BACKGROUND

There exists a growing consumer demand for textile items having differentiated designs, high quality, and fast delivery speed. Conventional process of screen printing. Performing this pre-treatment on shirts is a process that requires many steps, time, workforce and skills to get quality printed patterns. Convention processes require the application of a pre-treatment to the garment by spray, paint roll, or screen-printing techniques. This application can be performed automatically or manually. The pre-treated garments are then cured at 350° F. for 35 seconds. Digital printing is then applied to the garments. The garments are then exposed 350° F. for more 35 seconds to cure the inks. This procedure must be repeated for each application of a printed pattern to each part of the shirt, including front, back, sleeve or inside.

Other conventional systems perform wet-on-wet printing, such that the machines include pre-treatment. These machines are expensive. And other machines cannot be retrofitted with this capability.

Conventional reagents, chemicals, or additives (e.g., resins, binders, acids, bases or inorganic solvents) for pre-treatment are ineffective or inappropriate for direct-to-garment printing. For example, some chemicals reduce surface availability for white inks. As another example, some chemicals affect the final properties of the garment, such that only areas of the garment on which printing occurs are pretreated. These final properties can include hand feel, fabric strength, background color after heat press of printed pattern, and safety of final user of the garment. As yet another example, some chemicals can affect the quality of printing as the ink penetrates more deeply into the fibers and becomes less saturated. For another example, some chemicals can increase or cause dye migration by not creating barriers above the fabric. Some chemicals are ineffective on certain types of materials (e.g., synthetic fibers).

The state of the art would benefit from an improved pre-treatment process for direct-to-garment printing. The state of the art would also benefit from an improved solution for pre-treatment the garment or the fabric onto which direct-to-garment printing is performed.

BRIEF DESCRIPTION OF THE DRAWINGS

Non-limiting and non-exhaustive embodiments of the invention are described with reference to the following drawings. In the drawings, like reference numerals refer to like parts throughout the various figures, unless otherwise specified, wherein.

DETAILED DESCRIPTION

Figure 1:
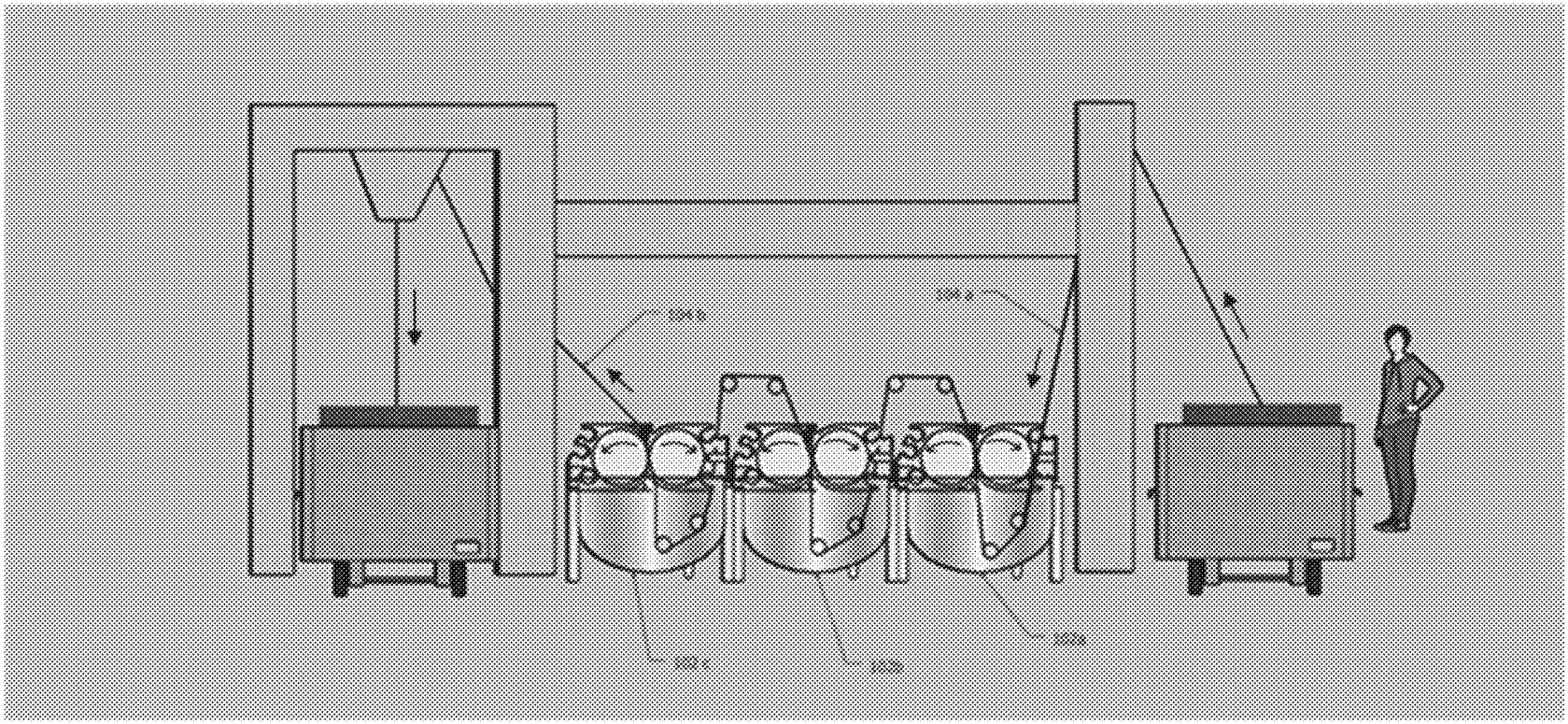
FIG. 1 shows an example system for producing a pre-treatment fabric to be converted in a ready to print garment.

The described systems and methods of direct-to-garment printing (DTG) allow for DTG printing for garments which achieves high definition and good color saturation, such as in dark color garments. The disclosed systems and methods include a pre-treatment solution to immobilize the ink used on the garments for DTG printing and to reduce or elimination ink absorption by the fabric (i.e., by reducing surface availability of polyvalent salt to contact). The reduction in ink absorption reduces the ink penetration through the fabric during the DTG printing process, which causes the ink to stay more superficial and a lower volume of ink is used to obtain vivid colors on the fabric.

The disclosed invention includes a method of producing ready-to-print garments for DTG printing process by pre-treating the fabric rather than the garment. The pre-treatment solution and the softener are applied separately. The pre-treatment solution and the softener can include drying or no drying in between applications.

The disclosed invention also includes a pre-treatment solution including amorphous nanoparticles and a hydrophobic softener. The hydrophobic softener can be used as a base to increase the performance of printing. The amorphous nanoparticles can increase the surface area of the fabric and inhibit migration of inks, such as by creating a barrier of sublimated disperse dyes to avoid contamination of a printed pattern in synthetic fabrics.

Besides the polyvalent salt and amorphous nanoparticles, the invention does not, in one example, include additives (e.g., resins, binders, acids, bases, cross-linkers, the like, or combinations or multiples thereof) that could affect garment final properties like hand feel, strength, color, etc. In other examples, for certain fabrics—like all-natural fabrics such as 100% cotton—a color booster can also be added to the fabric pre-treatment. In most pre-treated fabrics, the polyvalent salt changes the light reflection of the fabric to be duller (reflect less light) than the same, untreated fabric. Such a polyvalent salt is removed from the fabric after the first wash, which results in the color becoming darker—the light reflection increases when the polyvalent salt is removed from the fabric during the first wash. To avoid this color variation between garments made from these fabrics that are new (unwashed) and washed, a color booster is added to normalize the light reflection to a level that is within a desired range of the reflection value of the fabric without the polyvalent salt pre-treatment or the reflection value of the pre-treated fabric with the polyvalent sale pre-treatment after several washes. An example color booster is polyurethane resin. When the polyvalent salt is applied to the fabric along with the polyurethan resin, for example, the garment made of the pre-treated fabric gradually fades color rather than becoming darker after the first wash, as it would if only treated with the polyvalent salt without the color booster.

The disclosed articles of manufacture (e.g., fabrics, textiles, clothing, garments, upholstery, containers (e.g., bags or baskets), carpet, window shades, towels, coverings (e.g., for beds, tables, etc.), or the like) produced by a disclosed method, pre-treated with a disclosed solution, or produced by the disclosed method and the disclosed solution are ready-to-use pre-treated garment for DTG process. Relative to articles of manufacture produce by conventional methods or solutions, these articles of manufacture have an improved hand feel, have greater garment color saturation (i.e., improved color display), have improved or greater fiber strength, and are safer for use by manufacturers and ends users.

A system 100 for producing ready-to-print garments for a DTG printing process by pre-treating the fabric rather than the garment after it is created. The system includes three stages of pre-treatment that is applied to the fabric. The three stages of pre-treatment are continuous and performed using a wet-on-wet technique, which means each is applied while the fabric is wet—no drying steps occur between the three pre-treatment phases. The system 100 shown in FIG. 1 includes a series of pads 102*a-c* and a fabric feeder 104*a*. Each of the series of pads 102*a-c* includes a pair of pads. The fabric feeder 104*a* feeds untreated fabric to the three pad 102*a-c* system 100. The fabric feeder 104*b* is the resulting pre-treated fabric produced after the untreated fabric is treated through the three pad 102*a-c* system 100. In alternative examples, the three phases of pre-treatment can be applied using other methods that do not include pads such as freely submerging the fabric in the liquid bath, then pressing the saturated fabric to the desired saturation level at each stage. The pre-treatment in each phase can also be applied by spray to the fabric to reduce chemical consumption or can be applied by coating or other known techniques to apply finishing on fabrics.

The disclosed method pre-treats a feed fabric 104*a* to obtain a processed fabric 104*b*. The feed fabric 104*a* can be an untreated fabric or a fabric that has been dyed or bleached. In the example shown in FIG. 1, the system 100 includes a hydrophobic softener on a second pad 102*b* that is applied to the untreated fabric 104*a*. The hydrophobic softener reduces the ability of the fabric to absorb water, i.e., it makes the fabric less hydrophilic. Some materials have a greater hydrophilic characteristic, such as some natural materials like cotton, so the volume of applied hydrophobic softener can be varied based on the selected material, in some examples. When the hydrophobic softener is applied, the fabric resists a greater about of ink absorption during then digital printing process, particularly with color, to allow the ink to precisely saturate the fabric in the desired location and create a bright color application. Without the application of the hydrophobic softener, base white inks applied to the fabric during digital printing are absorbed quickly so a higher volume of ink is required to achieve the same result.

Alternatively, the fabric can be treated with a hydrophilic softener. Hydrophilic softeners require a greater volume of white ink during digital printing. However, the increased volume of ink, if factored into the printing process, can be worth the fabric properties that the hydrophilic softener can give the fabric, namely a quick dry effect for garments like sportswear and active wear for example. In this case the fabric retains the hydrophobic properties of the softener for the printing process and loses those properties after the first multiple—sometime several—wash cycles. The washed garment then retains the benefits of the hydrophilic properties over time and multiple wash cycles.

Referring again to FIG. 1, the pre-treatment solution is then applied in a second pad 102*b*. The hydrophobic softener acts as a base for the pre-treatment solution for a wet-on-wet process without the need of an intermediary drying process, such as for natural fabrics. Though pads 102*a*-102*c* are discussed herein for the application of different solutions, chemicals, or reagents, the solutions, chemicals, or reagents can be sprayed, coated or applied by other conventional methods onto the article of manufacture.

The wet-on-wet process means that fabric is wet after being dyed or bleached then it is fed into the three pads 102*a-c* shown in FIG. 1. Most conventional systems use a dry-on-wet technique to first saturate the fabric with water, then saturate it with a softener. After the softener application, the fabric is dried. After the fabric is dried, they may or may not apply additional pre-treatment to the fabric. If a final stage of pre-treatment is applied, such as a polyvalent salt, then the fabric must be dried a second time. In contrast, the disclosed system uses a wet-on-wet technique that applies the polyvalent salt to the fabric while the fabric is still wet. It is a third phase of liquid absorption rather than a drying phase. Only one drying phase is required for this pre-treated fabric, which reduces manufacturing time and cost. Applying the hydrophobic softener and the polyvalent salt, as disclosed here, separately in two steps optimizes the fabric absorption of each separate liquid. If the hydrophobic softener and the polyvalent salt were to be mixed together and applied at the same time to saturate the fabric, for example, it would reduce the available surface area for the polyvalent salt to absorb into the fabric which creates a non-uniform absorption and lower overall pick-up % because the hydrophobic softener competes with the polyvalent salt.

Figure 2:
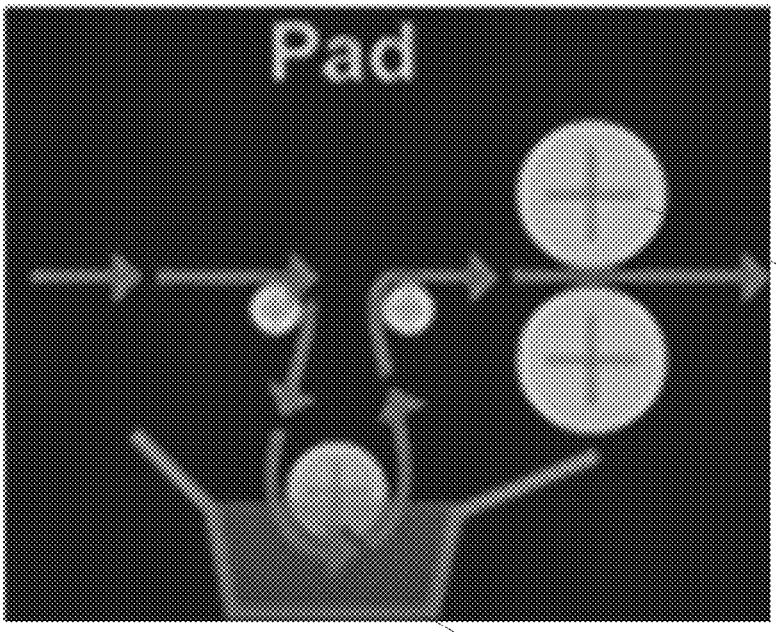
FIG. 2 shows a portion of a phase of an example system for pre-treating fabrics.

For an example with a hydrophobic softener applied, the hydrophobic softener can be prepared in side tanks and continually transferred to the second pad 102*b*. The fabric is emerged into the vat 106 of the second pad 102*b*. The vat 106 of the second pad 102*b* has the hydrophobic softener. After the fabric is emerged in the vat of the second pad 102*b*, the fabric is then pressed by the second pads 102*b*, as shown in FIG. 2. The fabric is pressed after it is submerged in the vat 106 to reduce overall fabric saturation to a range of 12-20% of the hydrophobic softener absorption. Overall fabric saturation is differential pick-up of the fabric of liquids in each phase.

Referring again to FIG. 1, a natural fiber is processed by the system 100. The first pad 102*a* applies or allows the fabric to absorb water to 60% of water over the fabric weight (ofw). The second pad 102*b* applies or causes the fabric to absorb the hydrophobic softener to 75% of the hydrophobic softener ofw. The differential absorption from the first pad 102*a* to the second pad 102*b* is 15% —the hydrophobic softener pick-up adds another 15% ofw to the fabric in addition to the water pick-up. The third pad 102*c* applies or causes the fabric to absorb the polyvalent salt to add another 10% ofw to the fabric in addition to the water and hydrophobic softener pick-up. The total pick-up for the fabric in this three step process is 90% in this example. Other pick-up values can be used depending on the fabric types and the desired pre-treated fabric characteristics. The differential pick-up varies in the second pad 102*b* and the third pad 102*c* between 12-20%. Some pressing can be done to adjust the pick-up volume to the desired level, as discussed above.

The pick-up percentages vary with different fabrics. For example, synthetic fabrics absorb less liquid than natural fibers. The differential at each of the three phases of pre-treatment is different—15% between the first pad and the second pad and another 15% between the second pad and the third pad or an overall range of 12-20% in each progress pick-up—however, the overall pick-up is lower because of the fabric qualities absorbing liquids differently and at a lower volume that natural fibers.

The disclosed methods also creates a barrier to avoid sublimation or migration of disperse dyes when the garment made from this fabric is exposed to heat during the DTG printing process. The disclosed method also reduces or eliminates stain printed patterns.

The disclosed method applies the chemicals separately, which improves printing quality. The sequence of three wet on wet impregnation steps can equalize the humidity from dyeing process. Then the hydrophobic softener can be applied. Then the DTG pre-treatment solution can be applied. The three impregnation steps can be done by the use of 3 pads or using 2 pads and a spraying system to apply the DTG pre-treatment solution.

The disclosed methods or solutions can include one or more of the following components or steps:

An application process, of a pre-treatment for digital printing process, in natural fabrics where it form is tubular or open width, for use to produce garments with the featured to be ready to be direct to garment printing instead of pre-treat in garment form, using technique of application of a hydrophobic softener as a base, following by an application, without intermediate fabric drying, of the pre-treatment for DTG process, including at least one of a) 2% to 40% of a polyvalent salt; b) 1% to 30% of amorphous nanoparticles; c) 1-20% solid dispersive diluent; d) 1-20% stabilizer solution; e) 1-10% booster; and f) 1-20% tension activator.

An application process, of a pre-treatment for digital printing process, in synthetic fabrics where it form is tubular or open width, for use to produce garments with the featured to be ready to be direct to garment printing instead of pre-treating in garment form, using technique of application of 2 barrier layers of amorphous nanoparticles following by an application of the pre-treatment for DTG process, including at least one of a) 2% to 40% of a polyvalent salt; b) 1% to 30% of amorphous nanoparticles; c) 1-20% solid dispersive diluent; d) 1-20% stabilizer solution; e) 1-10% booster; and f) 1-20% tension activator.

An application process for natural fibers comprising (1) production of the fabric from yarn by knitting or weaving process; (2) dyeing or whitening the fabric continuously or by batch; (3) fabric squeezing by pad with water to equalize humidity carried from dyeing process; (4) application by pad of a hydrophobic softener as a base; (5) application of pre-treatment solution for DTG process, composed of a polyvalent salt and amorphous nanoparticles, applied to the fabric through a pad or spray; (6) drying; (7) fabric spreading followed by cutting of garment parts; (8) garment sewing; (9) garment heat press for reduce fibrillation and form a smooth surface; (10) DTG printing process; and (11) garment heat press for cure printing inks.

An application process for synthetic fibers comprising (1) production of the fabric from yarn by flat knitting or weaving process; (2) dyeing or whitening the fabric continuously or by batch; (3) fabric squeezing by pad with water to equalize humidity carried from dyeing process; (4) application by pad or spray of amorphous nanoparticles; (5) pos-setting of fabric at 350° F. for 1 min; (6) application of pre-treatment solution for DTG process, composed of a polyvalent salt and amorphous nanoparticles, applied to the fabric through a pad or spray; (7) drying fabric at 250° F.; (6) fabric spreading followed by cutting of garment parts; (8) garment sewing; (9) garment heat press to form a smooth surface and form a smooth surface; (10) DTG printing process; and (11) garment heat press for cure printing inks.

An application process of the softener and pre-treatment can be performed using three pads. The three pads can be connected or separated.

An application process, wherein the fabric is contacted in a pad with an aqueous solution containing a softener with hydrophobic characteristics as a base to prevent penetration of the pre-treatment into the fabric increasing the area of interaction of the pre-treatment with the printing ink.

An application, wherein the fabric, already softened and without previous drying, is contacted with an aqueous solution of pre-treatment composed by a) a polyvalent salt and b) amorphous nanoparticles. And not making use of resins, binders, acids or bases that can affect the hand feel, resistance or color of the final garment and not making use of inorganic solvents that can affect operators health during the application of the product or final garment users by direct contact with the garment pre-treated in its full.

The amorphous nanoparticles can be used to increase the fabric surface area improving printing quality and avoiding the ink absorption by the fabric and its migration. The amorphous nanoparticles, when applied in synthetic fabrics, create a barrier layer and also absorb sublimated disperse dyestuff coming from dyed fabric when fabric is exposed to high temperature (e.g., temperatures greater than 245° f, including 250° f, 280-320° f, 280-350° f, or the like) during ink curing of printed fabric and so avoiding migrations from background to printed pattern. The amorphous nanoparticles can be silica nanoparticles. The pre-treatment, wherein the at least one polyvalent cationic salt has a cation that comprises a polyvalent cation of element Mg, Ca, Sr, Ba, Sc, Y, La, Ti, Zr, V, Cr, Mn, Fe, Ru, Co, Rh, Ni, Pd, Pt, Cu, Au, Zn, Al, Ga, In, Sb, Bi, Ge, Sn, Pb, or combinations thereof. The solid dispersive diluent can increase or enhance dispersion of solids within a pre-treatment step, during printing, or both within a pre-treatment step and during printing. The stabilizer solution can prevent degradation of the reagent or components thereof, can increase viscosity, or can prevent degradation and increase viscosity. The booster can improve or increase the functionality of one or more reagent components, including the polyvalent cationic salt. The tension activator can increase the interaction of one or more reagent components with fibers of the textile or garment being processed.

The hydrophobic softener can be used as a base to increase the performance of printing. The amorphous nanoparticles can increase the surface area of the fabric and inhibit migration of inks, such as by creating a barrier of sublimated disperse dyes to avoid contamination of a printed pattern in synthetic fabrics.

The pick-up of the first pad can be 30-70%, including 30-50%, 50-70%, or the like. The differential pick-up of the second pad can be 5-20%, including 5-15%, 10-20%, or the like. The differential pick-up of the third pad can be 10-20%.

Alternatively, the differential pick-up when the spray application instead of the third pad is used can be 7-15%.

Fabric post-setting process can be performed for 1 minute at 350° f.

Fabric drying can be performed for 1 minute at 250° f.

Heat pressing can be performed for 5-10 seconds at 300-350° f for natural fabrics. Heat pressing can be performed for 3-5 seconds at 250-280° f for synthetic fabrics.

Digital printing can be performed on or by a direct to garment printer, thereby producing a digitally printing fabric.

The digitally printed fabric can be heat pressed for 30-40 seconds at 300-350° f for natural fibers.

The digitally printed fabric can be heat pressed for 60-70 seconds at 250-280° f for synthetic fibers.

Though certain elements, aspects, components or the like are described in relation to one embodiment or example, such as an example system, those elements, aspects, components or the like can be including with any other systems, such as when it desirous or advantageous to do so.

The foregoing description, for purposes of explanation, used specific nomenclature to provide a thorough understanding of the disclosure. However, it will be apparent to one skilled in the art that the specific details are not required in order to practice the systems and methods described herein. The foregoing descriptions of specific embodiments are presented by way of examples for purposes of illustration and description. They are not intended to be exhaustive of or to limit this disclosure to the precise forms described. Many modifications and variations are possible in view of the above teachings. The embodiments are shown and described in order to best explain the principles of this disclosure and practical applications, to thereby enable others skilled in the art to best utilize this disclosure and various embodiments with various modifications as are suited to the particular use contemplated. It is intended that the scope of this disclosure be defined by the following claims and their equivalents.

What is claimed is:

1. A system for pre-treating fabric using a sequence of continuous, wet-on-wet impregnation steps, comprising:

a first phase that receives a feed of the fabric, the first phase configured to saturate the fabric in a first vat with a first liquid to a first pick-up value;

without drying occurring when the fabric leaves the first phase, a second phase configured to receive a continuous feed of the fabric from the first phase and to saturate the fabric in a second vat with a second liquid that differs from the first liquid and includes a softener, the fabric saturated to a second pick-up value in the second vat that exceeds the first pick-up value; and without drying occurring when the fabric leaves the second phase, a third phase configured to receive a continuous feed of the fabric from the second phase and to saturate the fabric with a third liquid after the saturation of the fabric by the second liquid is complete and that differs from the first liquid and the second liquid and includes a polyvalent salt, the fabric saturated to a third pick-up value that exceeds the second pick-up value, the fabric remaining saturated at a value between the first pick-up value and the third pick-up value throughout the first phase, second phase, and third phase of pre-treatment.

2. The system of claim 1, wherein the first liquid includes water.

3. The system of claim 1, wherein the second liquid includes a hydrophobic softener or a hydrophilic softener.

4. The system of claim 3, wherein the second liquid also includes amorphous nanoparticles.

5. The system of claim 1, wherein the first phase saturates the fabric with water and the first pick-up value is at least 40% of water over the fabric weight (ofw).

6. The system of claim 1, wherein the first phase saturates the fabric with water and the first pick-up value is at least 60% of water over the fabric weight (ofw).

7. The system of claim 1, wherein the second pick-up value is 15% more than the first pick-up value.

8. The system of claim 1, wherein the second pick-up value is within a range of 12-20% over the first pick-up value.

9. The system of claim 8, wherein the second phase includes:

saturating the fabric with a hydrophobic softener, and pressing the fabric to an ideal second pick-up value within the 12-20% range.

10. The system of claim 9, wherein the ideal second pick-up value is 15%.

11. The system of claim 8, wherein the third pick-up value is within a range of 12-20% over the second pick-up value.

12. The system of claim 11, wherein the third phase includes:

pressing the fabric to an ideal third pick-up value within the 12-20% range.

13. The system of claim 12, wherein the ideal third pick-up value is 15%.

14. The system of claim 1, wherein the first phase includes feeding the fabric between two rotating rollers to cause the fabric to be submerged in the first vat with the first liquid.

15. The system of 14, wherein the second phase includes feeding the fabric from the two rotating rollers of the first vat along two rotating rollers of the second vat having a second liquid, the second phase causing the fabric to be submerged in the second liquid of the second vat.

16. The system of claim 15, wherein the third phase receives a continuous feed of the fabric from the second phase, and includes a third vat having the third liquid and two rollers, the continuous feed of the fabric from the second phase fed between the two rollers of the third vat.

17. The system of claim 16, wherein the first vat includes two rotating rollers that are configured to rotate in opposite directions, and the second vat includes two rotating rollers that are configured to rotate in opposite directions, and the two rotating rollers of the third phase rotate in opposite directions.

18. The system of claim 1, further comprising a fourth phase that receives a feed of the fabric from the third phase and that dries the fabric saturated with the first liquid, the second liquid, and the third liquid.

19. The system of claim 1, further comprising a color booster phase that applies a color booster to the fabric before, during, or after the first phase.

20. The system of claim 16, wherein the third phase is configured to spray the fabric with the third liquid after the saturation of the fabric by the second liquid is complete.

21. The system of claim 16, wherein the third phase is configured to saturate the fabric in a third vat with the third liquid after the saturation of the fabric by the second liquid is complete.

* * * * *